United States Patent [19]

Varlamov

[11] 4,118,796

[45] Oct. 3, 1978

[54] DEVICE FOR PRODUCING ACOUSTIC VIBRATION IN FLOWING LIQUID OR GASEOUS MEDIUM

[76] Inventor: Vladimir Matveevich Varlamov, ulitsa 50 let Oktyabrya, 1, kv. 16, Zlatoust Chelyabinskoi oblasti, U.S.S.R.

[21] Appl. No.: 811,313

[22] Filed: Jun. 29, 1977

[51] Int. Cl.[2] ..... B01F 11/02

[52] U.S. Cl. ..... 366/124; 366/264

[58] Field of Search ..... 259/8, 24, 44, 108, 259/96; 366/124, 119, 118

[56] References Cited

U.S. PATENT DOCUMENTS

| | | | |
|---|---|---|---|
| 3,096,080 | 7/1963 | Willems | 366/124 X |
| 3,185,446 | 5/1965 | Blanchard | 366/124 X |
| 3,865,350 | 2/1975 | Burtis | 366/118 |

*Primary Examiner*—Billy S. Taylor
*Attorney, Agent, or Firm*—Burgess, Ryan and Wayne

[57] ABSTRACT

A device for producing acoustic vibration in a flowing liquid or gaseous medium, whereby a liquid or gaseous medium is continuously circulated and periodically subjected to local compression which is converted into mechanical oscillation and the medium produces acoustic vibration. The proposed device for producing acoustic vibration in a flowing liquid or gaseous medium comprises a rotor and a stator in coaxial arrangement, their side surfaces being provided with at least one row of holes. In the rotor, the number of holes in each row is less than in the stator. The device further includes an oscillator of an elastically deformable material, which encompasses the stator and is arranged in immediate proximity to its side surface, opposite the rows of holes. The device of this invention considerably increase the intensity of acoustic vibration, which makes it possible to speed up production processes and enlarge the volume of media being processed.

3 Claims, 10 Drawing Figures

DEVICE FOR PRODUCING ACOUSTIC VIBRATION IN FLOWING LIQUID OR GASEOUS MEDIUM

The present invention relates to high-power ultrasonics and, more particularly, to a device for producing acoustic vibration in a flowing liquid or gaseous medium and to a device for effecting this method. The device of this invention are chiefly used for high-rate mixing of liquids and the preparation of emulsions and suspensions, as well as for carrying out such processes as coagulation, mass and heat transfer and other physicochemical processes.

In every branch of industry, it is necessary to subject substances to the effects of high-power ultrasound. The main factor determining the effectiveness of such processes is the intensity of ultrasonic vibration, which must be sufficiently high. The sources of ultransonic vibration are to be simple and reliable.

There are many technical ideas concerned with methods and devices for producing acoustic vibration in liquid and gaseous media. At present, there exist magnetostriction, piezoelectric and mechanical sources of ultrasound. The operating principle of the magnetostriction and piezoelectric sources is based on the change in the size of a body acted upon by a magnetic or electric field. While operating in liquid and, especially, in gaseous media, the acoustic power of such sources is limited due to the relatively small amplitude of surface vibration which only amounts to a few microns. It must be reminded in this connection, by way of an example, that in order to produce a sound pressure of 160 db in the air, the radiator amplitude must be equal to 0.1 mm.

The mechanical methods of producing acoustic vibration envisage the action by a circulating medium on an elastic body to induce mechanical oscillation in that body. Acoustic vibration is produced as a result of the interaction of the elastic body with the medium in which it is secured or with a different medium. In the latter case the elastic body is also secured and serves as the boundary between two media, i.e., the technological medium and the working medium. The devices for effecting such methods comprise means to compress the circulating medium. If the elastic body interacts with the medium, wherein it is secured, it is constructed as a plate, and the circulation medium flows past this plate. If the elastic body separates two media, it is constructed as a membrane (diaphragm); each of the two surfaces of the membrane interacts with the respective medium.

The methods and devices under review can only provide acoustic vibration of limited intensity. In the former case, i.e., when the elastic body is secured in the medium with which it interacts, the limitation is due to the contact of the plate with a body having a different natural frequency. In the latter case, i.e., when the elastic body is a membrane, the intensity of acoustic vibration is limited due to the fact that acoustic energy is transmitted through an elastic body (a membrane or diaphragm) whose acoustic resistance is different from that of the medium, wherein acoustic vibration is produce There is known a method for producing acoustic vibration in a flowing liquid or gaseous medium, whereby a liquid or gaseous medium is continuously circulated and periodically subjected to local compression in order to produce acoustic vibration.

There is also known a device for effecting the above method of producing acoustic vibration in a flowing liquid or gaseous medium, comprising a housing which accommodates a stator and a rotor coaxially arranged in a liquid or gaseous medium continuously circulating through a hole provided in one of the end faces of the rotor, the closed cavity of said rotor, at least one row of holes provided on the side surface of said rotor, the gap between the side surfaces of the rotor and stator, and rows of holes in a number corresponding to that of the rows of holes of the rotor, provided on the side surface of the stator Periodic matching of the rotor and stator holes produces local compression of the liquid or gaseous medium in the stator hole In the foregoing device, periodic alignment and misalignment of the rotor and stator holes accounts for local compression and "rarefaction" of the circulating medium in the stator hole whereby acoustic vibration is produced in that medium. However the intensity of acoustic vibration thus produced is limited, which is due to the fact that the wave process is induced by the rotor and stator holes, where pinpoint compression of the medium takes place. When acoustic vibration is produced in a liquid medium, its intensity can be increased by enlarging the radiating surface, i.e., by increasing the number of holes in the rotor and stator and thus considerably increasing the size of the rotor and stator. If acoustic vibration is produced in gaseous medium, its intensity can be raised by increasing the shift of the radiating surface.

Apparently, the foregoing method and device can only make it possible to produce acoustic vibration of limited intensity It is an object of the present invention to provide a device to produce acoustic vibration of high intensity in a flowing liquid or gaseous medium.

The foregoing object is attained by providing a device for producing acoustic vibration in a flowing liquid or gaseous me dium, whereby a liquid or gaseous medium is continuously circulated and periodically subjected to local compression in ord to produce acoustic vibration in said medium, the proposed method being characterized, according to the invention, by tha local compression of the liquid or gaseous medium is converted into mechanical oscillation, whereupon acoustic vibration is produced as a result of interaction between the mechanical oscillation and said medium.

The object of the present invention is further attained by providing a device for effecting the proposed method of producing acoustic vibration in a flowing liquid or gaseous medium comprising a housing which accommodates a rotor and a stator coaxially arranged in a liquid or gaseous medium continuously circulating through a hole provided in one of the end faces of the rotor, the closed cavity of said rotor, at least one row of holes provided on the side surface of said rotor, the gap between the side surfaces of the rotor and the stator, and rows of holes in a number corresponding to that of the rows of holes of the rotor, provided on the side surface of the stator, which are periodically alinged with the holes of the rotor so that local compression of the liquid or gaseous medium is produced in said stator holes, which device is characterized, according to the invention, by that the number of holes in each row on the side surface of the rotor is less than the number of holes in each row on the side surface of the stator, and by that it includes an oscillator of an elastically deformable material, encompassing the stator and arranged in immediate proximity to its side surface, opposite said rows of holes of said stator.

If there are at least two rows of holes on the side surface of the stator, it is advisable that the oscillator should be made as a ring whose height is equal to or greater than the total height of the rows of holes and the gaps between the rows of holes of the stator.

If there are at least two rows of holes on the side surface of the stator, it is equally advisable that the oscillator should be composed of separate rings in a number corresponding to that of the rows of holes of the stator, each ring being arranged opposite to the respective row of holes of the stator and having a height which is equal to or greater than the axial size of the holes.

The proposed method and device for producing acoustic vibration in a flowing liquid or gaseous medium make it possible to substantially increase the intensity of acoustic vibration, which, in turn, makes it possible to speed up technological processes and expand the volume of media being processed Other objects and advantages of the present invention will be more readily understood from the following detailed description of preferred embodiments thereof to be read in conjunction with the accompanying drawings, wherein.

The proposed method for producing acoustic vibration in a flowing liquid or gaseous medium is based on the interaction between a ring-shaped oscillator of an elastically deformable material and the medium. For better understanding of the way mechanical oscillation of the oscillator is produced, FIGS. 1, 2, 3 and 4 conventionally show changes in the geometrical dimensions of a ring 1, brought about by forces applied to the internal surface of said ring 1. The forces are of an equal magnitude and uniformly applied in the radial direction along the circumference of the ring 1. The forces are selected so as not to exceed the elastic deformation limit of the ring 1.

Figure 1:
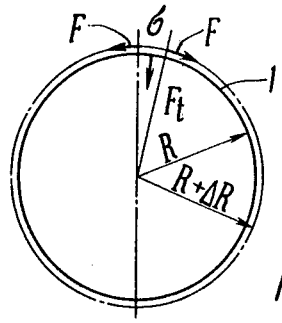
FIG. 1 is a schematic representation of the oscillator of the proposed device for producing acoustic vibration in a flowing liquid or gaseous medium, acted on by forces F.

Radial forces F are applied to each point of the internal surface of the ring 1, along its circumference, and bring about the deformation $R + \Delta R$, as shown by the dash lines in FIG. 1. The deformation means a change in the circumferential length of the ring 1 by a value of $\delta$. In case of an instantaneous removal of the tensile forces, the resultant $F_t$ of the tangential forces is applied in the radial direction and brings the ring 1 back to the normal state.

Figure 2:
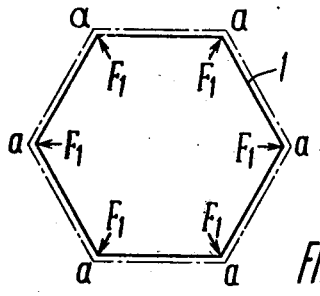
FIG. 2 is a view of the oscillator of FIG. 1, acted on by forces $F_1$.

Similar changes in the circumferential length of the ring 1 by a value of $\delta$ occur as a result of the application of forces $F_1$ to the internal surface of the ring 1. The value of the sum total of these forces is equal to that of the tensile force F, but the forces $F_1$ are applied to several points "*a*" uniformly spaced along the circumference of the ring 1. As shown in FIG. 2, the forces $F_1$ give the ring 1 the shape of a polygon with the vertices at the points "*a*" whereto the forces $F_1$ are applied. The change in the circumferential length of the ring 1 corresponds to the change in the length of the polygon's perimeter. Following an instantaneous removal of the forces $F_1$ applied at the points "*a*", the restoring forces shift the vertices of the polygon in the radial direction, whereas the tangential forces $F_t$ restore the original shape of the ring 1.

Figure 3:
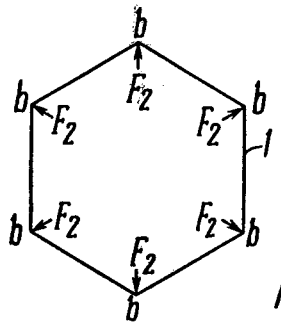
FIG. 3 is a view of the oscillator of FIG. 1, acted on by forces $F_2$.

When forces $F_2$, equal to the forces $F_1$, are applied at points "*b*" as shown in FIG. 3, the ring 1 also assumes the shape of a polygon with vertices at the points "*b*" located between the points "*a*".

Figure 4:
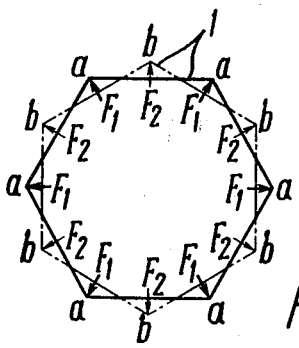
FIG. 4 is a view of the oscillator of FIG. 1, acted on by forces $F_1$ and $F_2$.

As shown in FIG. 4, the alternation of the points "*a*" and "*b*" uniformly spaced along the circumference of thr ring 1, whereto there are applied the radial forces $F_1$ and $F_2$, results in a change of the circumferential length of the ring 1 by a value of $\delta$ and simultaneously produces mechanical oscillation. The latter results in a considerable linear displacement of the plurality of points of the ring 1, located between the points "*a*" and "*b*" of application of the forces $F_1$ and $F_2$, respective The maximum displacement of points on the surface of the ring correspond to the shift of the middles of the sides of one polygon to the vertices of another polygon and vice versa.

The most advantageous use of such a displacement is to produce acoustic vibration in a flowing liquid or gaseous medium, whose power is proportional to the displacement rate of the wall of the ring 1 which oscillates as a system of masses that are circumferentially distributed and shifted cophasally in the radial direction. The frequency, at which the periodically alternating radial forces $F_1$ and $F_2$ are applied to the internal surface of the ring 1, is selected to be close or equal to the natural frequency of the oscillator, for which purpose there is increased the number of points at which these forces are applied. That notwithstanding, the value of the linear displacement of the walls of the ring 1 is one order greater than the deformation of the conventional harmonic oscillation systems. The considerable displacement of the walls of the ring 1 determines the intensity of acoustic vibration in a liquid or gaseous medium, which depends on the scope of oscillatory displacement of the harmonic oscillator.

The proposed method for producing acoustic vibration in a flowing liquid or gaseous medium is effected with the aid of a device which produces the forces $F_1$, $F_2$, etc. and determinces the sequence of their application to the internal surface of the ring 1, first, at all the points "*a*", then at all the points "*b*", etc., at a frequency which is close to the natural frequency of the ring 1.

Figure 5:
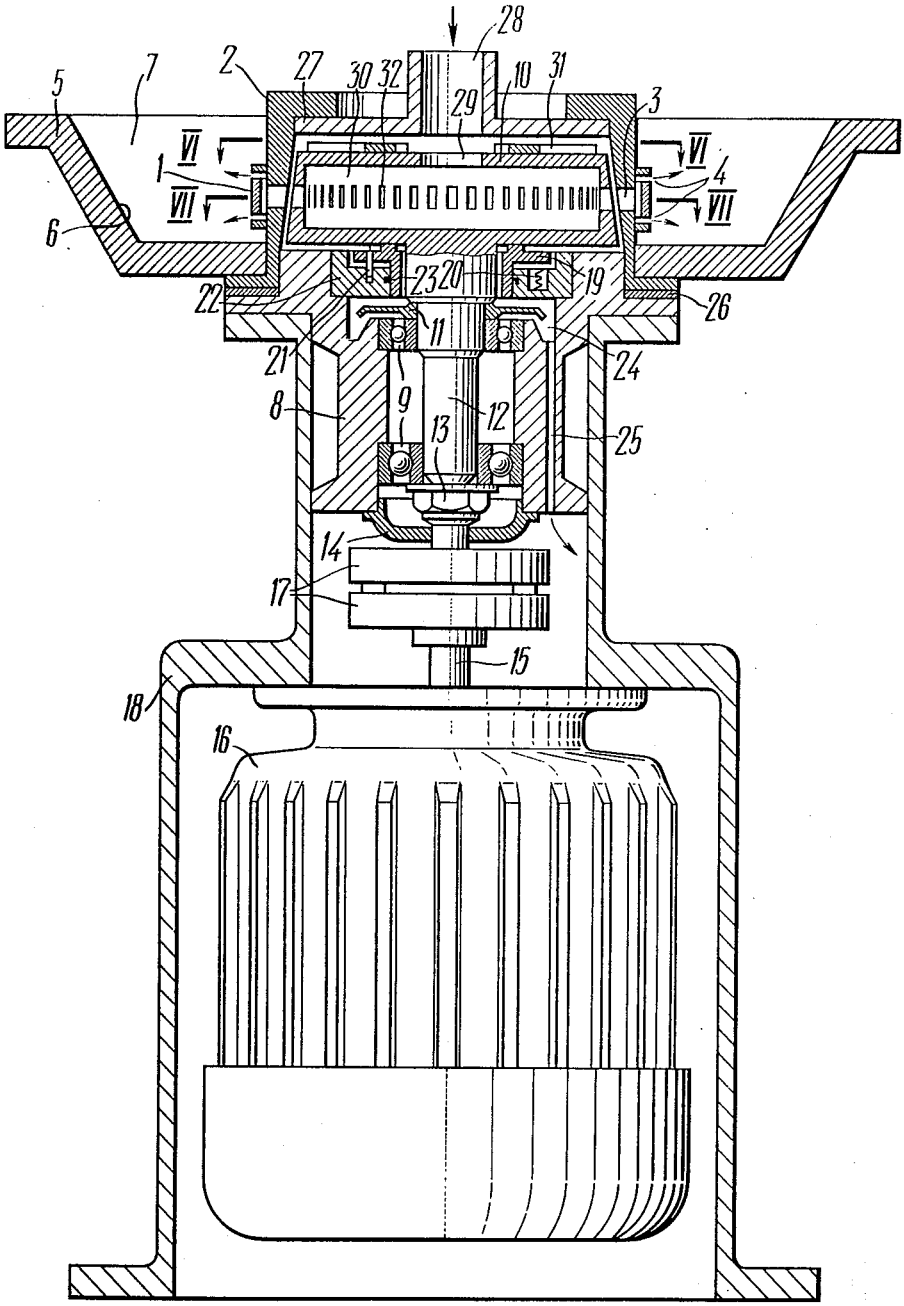
FIG. 5 is a cut-away elevation view of the proposed device for producing acoustic vibration in a flowing liquid or gaseous medium.

In the proposed device, the ring 1 encompasses a stator 2 (FIG. 5) which is a hollow cylinder on whose side surface there is provided at least one row of holes 3. The height of the ring 1 is greater than that of the holes 3. Axial displacement of the ring 1 is avoided, and said ring 1 is kept opposite the holes 3 by ring-shaped stops 4 provided on the side surface of the stator 2. The clearance between the stops 4 is greater than the height of the ring 1.

Also secured to the side surface of the stator 2 is a reflector 5 having a surface 6 for reflecting acoustic vibration. The surface 6 ensures a predetermined direction in which oscillation is sent into a liquid or gaseous medium. In order to produce acoustic vibration in a liquid medium, the reflector 5 can be made integral with a vessel filled with a liquid medium; it may also be submerged in the liquid medium. In any case, a cavity 7, formed by the reflector 5 and the side surface of the stator 2, is the active zone of propagating acoustical waves.

The stator 2 and reflector 5 are rigidly coupled to a housing 8, wherein in bearings 9 there is installed a rotor 10. The latter is arranged coaxially with the stator 2 and is shaped as a hollow cylinder, over which there is fitted a washer 11 intended to protect the bearings 9 from the liquid medium. Axial displacement of a shaft 12 of the rotor 10 is limited by a nut 13. The lower part of the housing 8 is covered by a lid having an opening through which extends the shaft 12 of the rotor 10, which shaft 12 is coupled to a shaft 15 of a motor 16 by a coupling 17. The motor 16 and housing 8 are rigidly mounted on a base 18.

The end face of the rotor 10 is in permanent contact with a packing bush 19 which is pressed to the rotor 10 by springs 20 and is provided with stops 21 to prevent its turning about its axis. The springs 20 and stops 21 are arranged in a ring 22 rigidly secured in the housing 8. The bush 19 is hermetically coupled to the ring 22 by means of a sealing ring 23 which allows of free vertical travel of the bush 19.

In the housing 8, provision is made for an annular cavity 24 communicating with the atmosphere through a channel 25.

The external surface of the rotor 10 and the internal surface of the stator 2 are inclined to their respective rotation axes. This is due to the necessity of having a gap between the two surfaces in order to ensure desired operating conditions. The width of the gap is set by moving the stator 2 with the reflector 5 along the axis of rotation, which, in turn, is ensured by changing the thickness of a ring 26 interposed between the stator 2 and the housing 8; the thickness of said ring 26 is proportional to the width of said gap.

Figure 6:
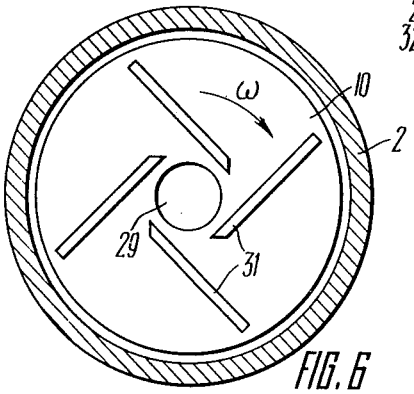
FIG. 6 is a section taken on line VI—VI of FIG. 5.

The internal end face surface of the stator 2 is covered by a flange 27 rigidly secured to said stator 2. In the flange 27 there is provided a channel 28 aligned with an opening 29 made in the upper end face of the rotor 10 and intended to supply the medium to closed cavity 30 of the rotor 10. On the external side, the upper end face of the rotor 10 is provided with protrusions 31 intended to maintain the pressure head of the medium in the gap between the rotor 10 and the stator 2. In the embodiment under review, the protrusions 31 (FIG. 6) are arranged tangentially with respect to the opening 29 of the rotor 10 and are of a rectangular shape.

The protrusions 31 may be bent or have some other shape appropriate for delivering the medium into said gap. The flange 27 (FIG. 5) may be integral with the stator 2. However, the clearance between the protrusions 31 and the flange 27 must be as small as possible to deliver the medium into the gap between the rotor 10 and the stator 2.

On the side surface of the rotor 10 there are provided rows of holes 32 in a number corresponding to that of the rows of holes 3 of the stator 2. In the embodiment under review there is one row of holes 32. The number of the holes 32 in the rotor 10 is less than that of the holes 3 in the stator 2, which is necessary to alternate the points at which the forces $F_1$ and $F_2$ are applied to the ring 1.

Figure 7:
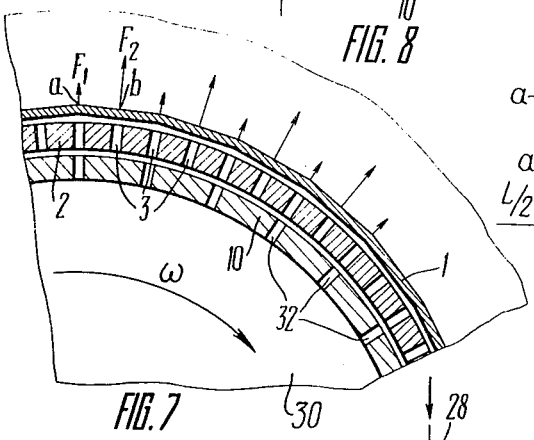
FIG. 7 is a cut-away sectional view taken on line VII—VII of FIG. 5.

As is clear from FIG. 7, in the course of rotation of the rotor 10 at a constant angular speed $\omega$ all the holes 32 are periodically aligned with the holes 3 of the stator 2 so that the forces $F_1$ are applied at the points "*a*" uniformly spaced along the circumference of the ring 1; at the same time at the points "*b*", where the forces $F_2$ are applied, the holes 3 are overlapped by the spacings between the holes 32. As the rotor 10 continues to rotate, the spacings between its holes 32 overlap all the holes 3 corresponding to the points "*a*" at which the forces $F_1$ are applied. The holes 3, corresponding to the points "*b*" at which the forces $F_2$ are applied, are aligned with the holes 32 of the rotor 10. Such a periodic alignment of the holes 32 of the rotor 10 and the holes 3 of the stator 2 ensures alternating application of the forces $F_1$ and $F_2$ to the internal surface of the ring 1 at a frequency derived from the following equation:

$$f = \frac{m Z_s}{60}, \tag{1}$$

where

*m* is the number of revolutions per minute of the shaft 12 of the rotor 10; and $Z_s$ is the number of the holes 3 in the row of holes of the stator 2.

In order to increase the frequency at which the forces $F_1$ and $F_2$ are applied to the internal surface of the ring 1, i.e., bring this frequency as close as possible to the natural oscillation frequency of the ring 1, while keeping the size of the device at a minimum, there is proposed a second embodiment of the device, which is similar to the one described above.

Figure 8:
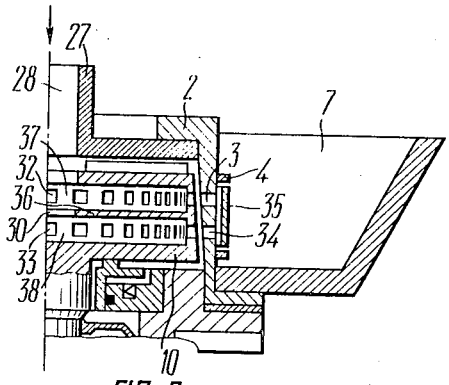
FIG. 8 is an elevation view of a part of the proposed device with two rows of holes in the rotor and stator and one oscillator, in accordance with the invention.

The second embodiment of the proposed device differs from the first one in that both the rotor 10 and the stator 2 have an additional row of holes, i.e., a row of holes 33 (FIG. 8) in the rotor 10 and the row of holes 34 in the stator 2. The number of the holes 33 corresponds to that of the holes 32 in the rotor 10, whereas the number of the holes 34 corresponds to that of the holes 3 in the stator 2. In the second embodiment, a ring 35, arranged in immediate proximity to the holes 3 and 34, has a height which is greater than the total height the rows of holes 34 and 3 and the spacing between these holes. As in the first embodiment, some clearance is allowed between the stops 4 and the end faces of said ring 35. The holes 33 of the additional row of holes of the rotor 10 are coaxial with the holes 32; the holes 34 of the additional row of holes of the stator 2 are displaced with respect to the holes 3 (FIG. 9) by (L/2), where L is the distance between the axes of adjacent holes 3 of the stator 2.

Such an arrangement of the holes 34 and 3 on the side surface of the stator 2 is meant to provide for a complex deformation of the ring 35 (FIG. 8) at double the frequency *f* at which the forces $F_1$ and $F_2$ are applied, as compared to the first embodiment of the device. The equation (1) is now expressed as follows:

$$f = \frac{m \cdot Z_s \cdot n}{60}, \quad (2)$$

where $n$ is the number of holes in the stator 2 and the rotor 10.

If two rows of holes are provided in the rotor 10, it is desirable that the latter's cavity 30 should be divided by an annular protrusion 36 into two cavities 37 and 38. This ensure equal magnitudes of the forces F irrespective of changes in the points at which these forces are applied, which, in turn, ensures stable mechanical oscillation of the ring 1 (FIGS. 1, 2, 3 and 4).

In order to increase the amplitude of mechanical oscillation of the ring 1, i.e., increase the amplitude of acoustic vibration in a liquid or gaseous medium, there is proposed a third embodiment of the device, which is similar to the second one.

This latter embodiment differs from the former ones in that a separate ring is arranged opposite each row of holes of the stator 2. A ring 39 corresponds to the holes 3 (FIG. 10) of the stator 2. A ring 40 is arranged in a similar manner relative to the holes 34. Axial displacement of the rings 39 and 40 is prevented by the stops 4.

Figure 9:
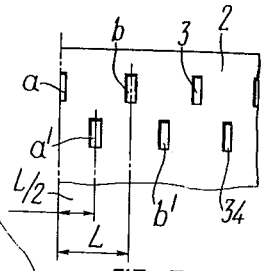
FIG. 9 is a developed view of a portion of the side surface of the stator, in accordance with the invention.

The third embodiment of the device is such that each ring 39 and 40 produces acoustic vibration. Depending on the arrangement of the holes 34 with respect to the holes 3 of the stator 2, the acoustic vibration resulting from mechanical oscillation of each of the rings 39 and 40 may be cophasal, antiphase, or phase-shifted. In order to produce cophasal acoustic vibration the holes 3 and 34 of the stator 2 and the holes 32 and 33 of the rotor 10 are arranged coaxially one below the other. In order to produce acoustic vibration in antiphase, the holes 34 of the stator 2 are displaced with respect to the holes 3 by L/2, as shown in FIG. 9. A phase shift is effected by changing L/2. In the third embodiment, there are two rows of holes 32, 33 and 3, 34 in the rotor 10 and the stator 2, respectively; of course, the number of wows can be increased.

In order to produce acoustic vibration in a circulating liquid medium used in different technological processes, it is advisable that the cavity 7 should be closed. In such a case, the cavity 7 is formed by a chamber 41 rigidly secured on the end faces of the stator 2 and having a channel 42 to let out the medium, and a surface 43 spaced from the radiator at a distance which is multiple to one half of the wavelength. The surface 43 is intended to send acoustic vibration into the flowing medium.

The proposed device for producing acoustic vibration in a flowing liquid or gaseous medium operates as follows.

In order to produce acoustic vibration in a liquid medium, the device is placed in a vessel (not shown) so that the stator 2 (FIG. 5), the rotor 10 and the cavity 7, formed by the side surface of the stator 2 and the reflector 5, are submerged in the medium, for example, water. The water is then continuously circulated, for which purpose it is directed under pressure through the channel 28 and the opening 29 provided in the end face of the rotor 10 to the cavity 30 of the rotor 10, wherefrom the medium is forced into the cavity 7 which is part of the vessel, through the holes 32 of the rotor 10, the gap between the rotor 10 and the stator 2, which takes place if all the holes 32 and 3 are misaligned, the holes 3 of the stator 2, the gap formed by the external surface of the stator 2 and the internal surface of the ring 1, and the gaps between the end faces of the ring 1 and the stops 4. The rotor 10 is then set into rotation at an angular speed $\omega$. This is done by the motor 16 through the coupling 17 which couples the shaft 15 of the motor 16 to the shaft 12 of the rotor 10.

In the course of rotation of the rotor 10, its holes 32 are periodically aligned with the holes 3 of the stator 2 (FIG. 7), whereby there is produced local compression of the circulating medium in the holes 3 of the stator 2. The energy of the local compression is applied to the internal surface of the ring 1 of an elastically deformable material. This energy is simultaneously applied at all the points "*a*", then at all the points "*b*", etc. These forces deform the surface of the ring 1 so that as the forces $F_1$ are applied at the points "*a*", the internal surface of the ring 1 at the points "*b*" tends to come as close as possible to the external surface of the stator 2. Similarly, as the forces $F_2$ are applied at the points "*b*", the internal surface of the ring 1 at the points "*a*" tends to come closer to the surface of the stator 2. However, the ring 1 never comes into contact with the surface of the stator 2 because of the circulating medium.

Likewise, the ring 1 never comes into contact with the stops 4 (FIG. 5), which is due to the fact that the streams of the medium between the end faces of the ring 1 and those of the stops 4 correspond to equal conditions under which the forces of the circulating medium are applied to the internal surface of the ring 1, whereby the ring 1 is suspended in the circulating medium. The suspension of the ring 1 is also due to the ptrotrusions 31 of a centrifugal pump, arranged on the upper end face of the rotor 10, which protrusions 31 account for a constant pressure of the liquid medium in the gap between the rotor 10 and the stator 2. Thus, the ring 1 (FIG. 7), submerged in the circulating medium, is in a state of radial and flexural vibration. The frequency of the application of the forces F, which is proportional to the product of the number of the holes 3 of the stator 2 by the rotation speed of the rotor 10, is selected to be equal or close to the natural oscillation frequency of the ring 1. Hence, the radial and flexural oscillation of the ring 1 occurs at a frequency which is equal to the natural frequency of the ring 1, and accounts for a considerable displacement of the surface of the ring 1 which is a harmonic oscillator radiating high-power acoustic vibration into the medium.

If both the rotor 10 and the stator 2 have two rows of holes on their side surfaces, i.e., the holes 32 (FIG. 8), 33 and 3, 34, respectively, the forces $F_1$ are simultaneously applied to the internal surface of the ring 1 at all the points "*a*" (FIG. 9) of the row of holes 3 of the stator 2, then, also simultaneously, at all the points "*a'*" of the row of holes 34 of the stator 2; the forces $F_2$ are then applied at the points "*b*" of the row of holes 3 of the stator 2, whereupon the forces $F_2$ are applied at the points "*b'*" of the row of holes 34 of the stator 2, etc.

The alternating application of the forces $F_1$ and $F_2$ to the internal surface of the ring 1 causes complex deformation of the ring 1 at double the frequency of the application of the forces F, as compared to the above embodiment of the device.

Figure 10:
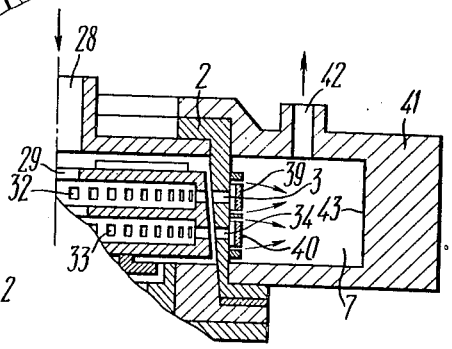
FIG. 10 is an elevation view of a part of the proposed device with two rows of holes in the rotor and stator and two oscillators, in accordance with the invention.

In the embodiment of FIG. 10, acoustic vibration is radiated into the medium by two individual oscillators, i.e., the rings 39 and 40, each being in a state of radial and flexural vibration due to the application of the forces $F_1$ and $F_2$ to their internal surfaces. The sequence of applying the forces $F_1$ and $F_2$ is described above.

However, depending on the arrangement of the holes 34 with respect to the holes 3 of the stator 2, the acoustic vibration, resulting from the mechanical oscillation of each of the rings 39 and 40, is cophasal when the holes 3 and 34 of the stator 2 and the holes 32 and 33 of the rotor 10 are coaxially aligned; otherwise the phases are shifted relative to each other. In the latter case the holes 34 of the stator 2 are displaced relative to the holes 3 within the value of L/2 (FIG. 9). The maximum displacement of the holes produces vibration in antiphase.

What is claimed is:

1. A device for producing acoustic vibration in a flowing liquid or gaseous medium, comprising: a housing; a stator secured in said housing; a rotor arranged coaxially with said stator in the medium; a side surface of said rotor; at least one row of holes provided on said side surface of said rotor; a side surface of said stator; rows of holes in a number corresponding to that of said rows of holes of said rotor, provided on said side surface of said stator; the number of said holes in each row of holes of said rotor being less than the number of holes in each row of holes of said stator; end faces of said rotor; an opening provided in one of said end faces of said rotor; a closed cavity of said rotor; a gap between said rotor and said stator; a pump to continuously circulate said medium through said opening provided in said end face of said rotor, said closed cavity of said rotor, said rows of holes of said rotor, said gap between said rotor and said stator, and said rows of holes of said stator; an electromotor to rotate said rotor so as to produce local compression of said medium of said holes of said stator as a result of periodic alignment of said rows of holes of said rotor with those of said stator; an oscillator of an elastically deformable material, encompassing said stator, arranged in immediate proximity to said side surface of said stator, opposite said rows of holes, and intended to convert said local compression of said medium into mechanical oscillation to interact with said medium, whereby acoustic vibration is produced.

2. A device as claimed in claim 1, comprising: at least two said rows of holes provided on said side surface of said stator; spacings between said rows of holes of said stator; a ring performing the function of said oscillator, whose height is approximately equal to the total height of said rows of holes and said spacings between said rows of holes of said stator.

3. A device as claimed in claim 1, comprising: at least two said rows of holes provided on said side surface of said stator; a group of rings performing the function of said oscillator, the number of said rings being determined by the number of said rows of holes of said stator; each of said rings being arranged opposite a respectible row of holes of said stator and having a height which is approximately equal to the axial size of said holes.

* * * * *

UNITED STATES PATENT OFFICE

CERTIFICATE OF CORRECTION

Patent No. 4,118,796 Dated October 3, 1978

Inventor(s) Vladimir Matveevich Varlamov

It is certified that error appears in the above-identified patent and that said Letters Patent are hereby corrected as shown below:

Column 1, line 63: "produce" should be --produced--.

Column 2, line 18: Replace "hole" by --holes--.

line 33: After "intensity" insert a period.

line 39: "me dium" should be --medium--.

line 41: "ord" should be --order--.

line 43: "tha" should be --that--.

line 60: "alinged" should be --aligned--.

Column 4, line 33: "respective" should be --respectively.--.

line 35: After "ring" insert --1--.

line 51: After "of the" insert --vibrating body in--.

line 60: "determinces" should be --determines--.

Column 5, line 23: After "lid" insert --14--.

Column 6, line 53: After "height" (2nd occurrence) insert --of--.

UNITED STATES PATENT OFFICE

CERTIFICATE OF CORRECTION

Patent No. 4,118,796 Dated October 3, 1978

Inventor(s) Vladimir Matveevich Varlamov

It is certified that error appears in the above-identified patent and that said Letters Patent are hereby corrected as shown below:

Column 8, line 31: "ptrotrusions" should be --protrusions--.

Column 10, line 26: "respectible" should be --respective--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademar*